US005309333A

United States Patent [19]

Kandampully

[11] Patent Number: 5,309,333

[45] Date of Patent: May 3, 1994

[54] LIGHT EMITTING FOLDABLE DECORATION

[76] Inventor: Vijay K. Kandampully, 34, Ford Park Road, Plymouth, England, PL4 6NU

[21] Appl. No.: 851,881

[22] Filed: Mar. 16, 1992

[51] Int. Cl.[5] ..... A47G 33/00

[52] U.S. Cl. ..... 362/121; 362/352; 362/807; 428/11

[58] Field of Search ..... 362/121, 807, 352; 428/8, 11, 7

[56] References Cited

U.S. PATENT DOCUMENTS

| | | | |
|---|---|---|---|
| 2,652,653 | 9/1953 | Ober | 362/121 |
| 2,671,286 | 3/1954 | Hansen | 428/8 |
| 4,214,023 | 7/1980 | Day | 428/11 |
| 4,605,996 | 8/1986 | Payne | 362/352 |
| 4,758,936 | 7/1988 | Maxwell | 362/352 |
| 4,930,053 | 5/1990 | Vaught | 362/121 |

*Primary Examiner*—Henry F. Epstein
*Attorney, Agent, or Firm*—Michael I. Kroll

[57] ABSTRACT

A light emitting foldable decoration is provided for a socket holder fixture with a light bulb suspended by a power cord form a mounting plate on a ceiling of a building. The decoration consists of a structure connected to the socket holder fixture for screening the light bulb and another structure for covering the screening structure, so that the covering structure will allow some of the light illuminating from the light bulb to enhance the appearance of the covering structure.

7 Claims, 2 Drawing Sheets

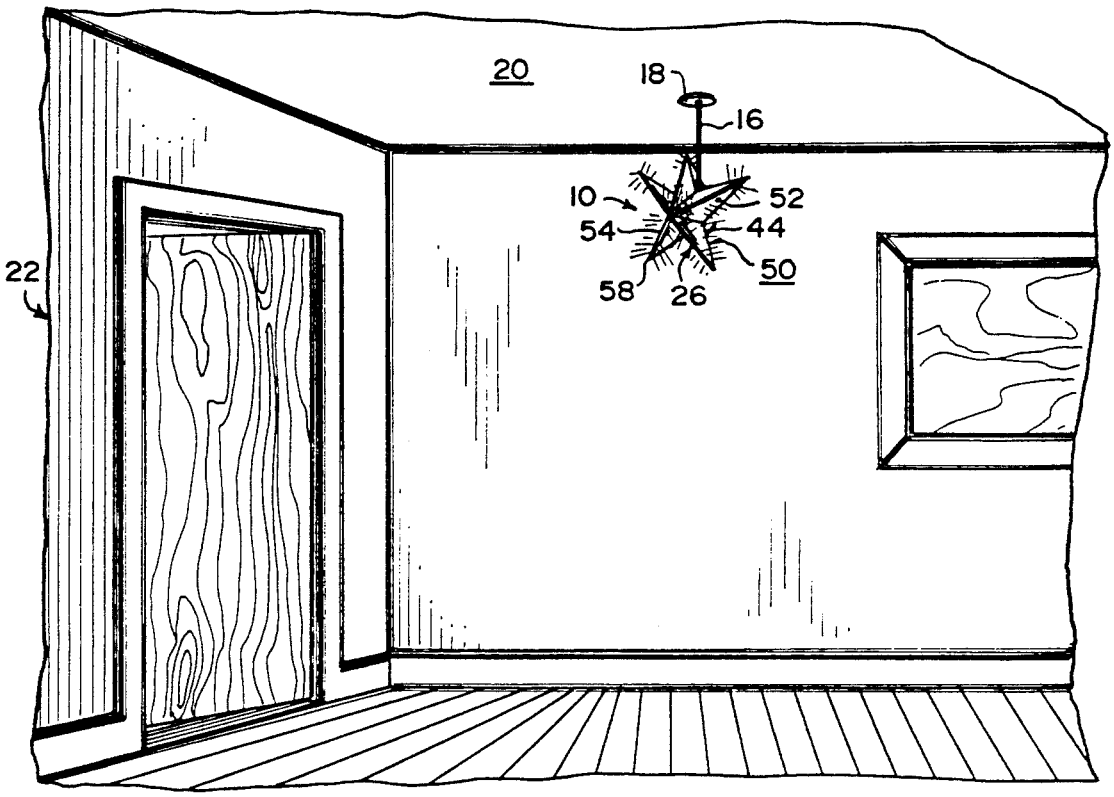
Fig. 1
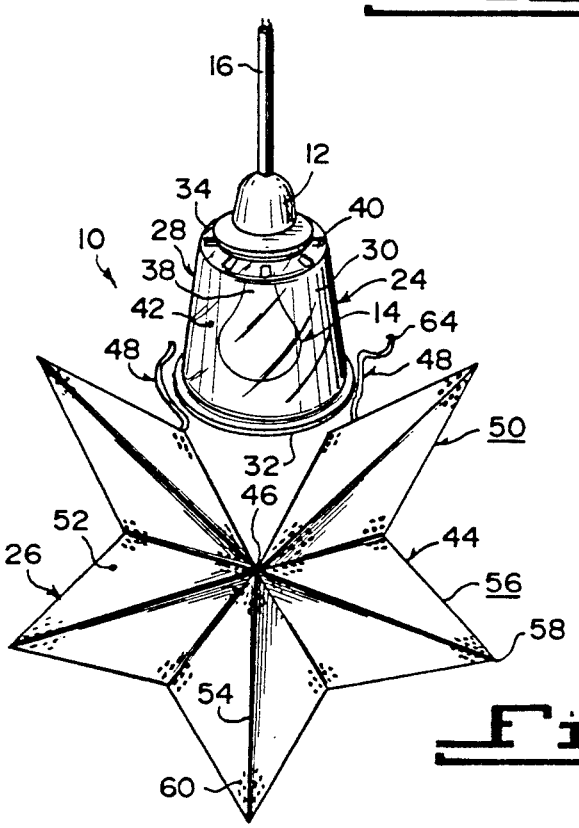
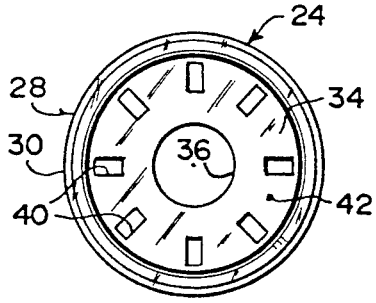
Fig. 2
Fig. 3

LIGHT EMITTING FOLDABLE DECORATION

BACKGROUND OF THE INVENTION

1. Field of the Invention

The instant invention relates generally to illuminated ornaments and more specifically it relates to a light emitting foldable decoration.

2. Description of the Prior Art

Numerous illuminated ornaments have been provided in prior art that are adapted to be adorned are considered to be beautiful bright objects and made in various types of geometric configurations. While these units may be suitable for the particular purpose to which they address, they would not be as suitable for the purposes of the present invention as heretofore described.

SUMMARY OF THE INVENTION

A primary object of the present invention is to provide a light emitting foldable decoration that will overcome the shortcomings of the prior art devices.

Another object is to provide a light emitting foldable decoration that contains an extendable adornment and lamp shade which are attached to a ceiling suspended socket holder fixture with a 25 watt light bulb, so that the illumination from the 25 watt light bulb can enhance the appearance of the extendable adornment.

An additional object is to provide a light emitting foldable decoration in which the extendable adornment is a three dimensional geometric shaped embellishment, that can be collapsed into a closed position and be stored when not in use.

A further object is to provide a light emitting foldable decoration that is simple and easy to use.

A still further object is to provide a light emitting foldable decoration that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention in use in a room of a building.

FIG. 2 is a top view of the lamp shade of the instant invention.

FIG. 3 is a perspective view of the ceiling suspended socket holder fixture with the lamp shade ready to receive the extendable adornment thereto.

DETAILED DESCRIPTION OF THE PREFERRED EMBODIMENTS

Figure 4:
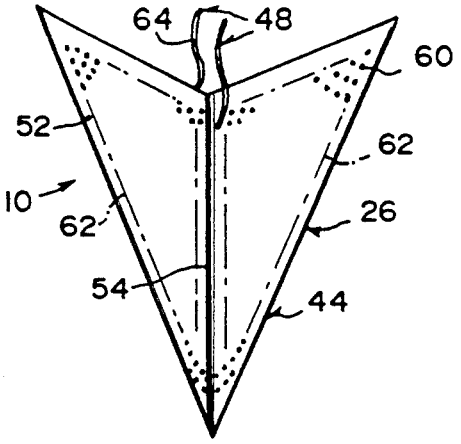
FIG. 4 is a side view of the extendable adornment in its folded collapsed closed position.
Figure 7:
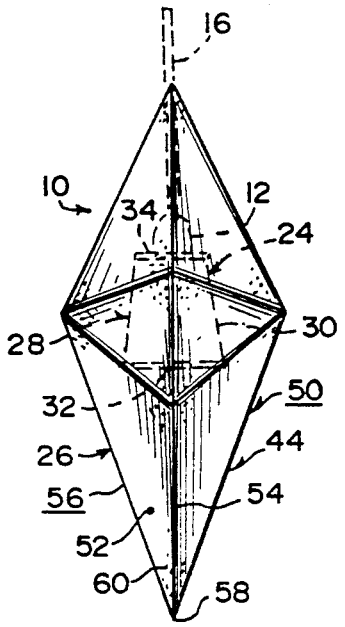
FIG. 7 is a side view taken in direction of arrow 7 in FIG. 6.
Figure 5:
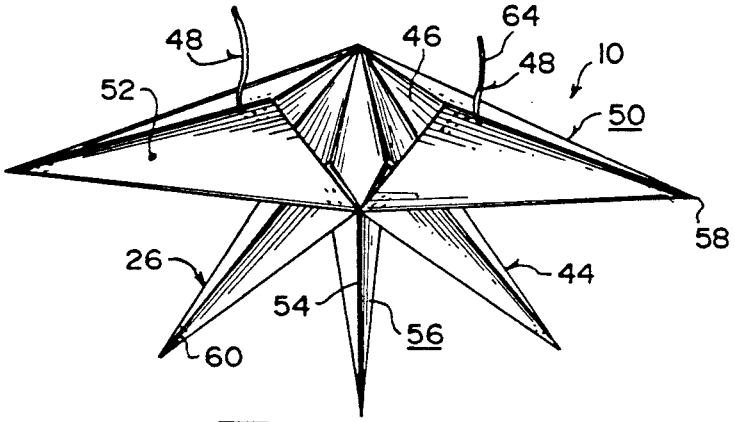
FIG. 5 is a top perspective view of the extendable adornment partially in its opened position.
Figure 8:
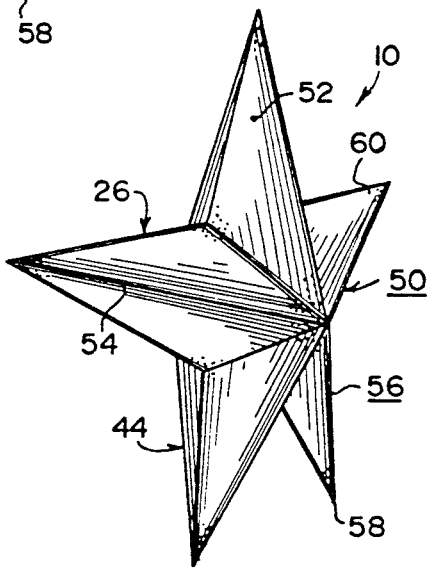
FIG. 8 is a front perspective view of the extendable adornment in its opened position.
Figure 6:
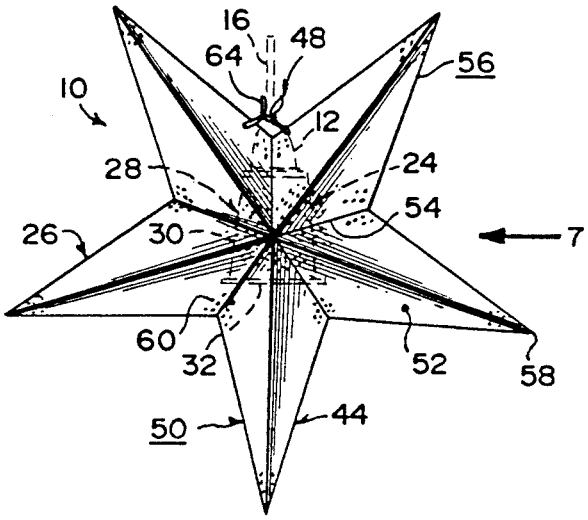
FIG. 6 is a front view of the extendable adornment in its opened position, showing the ceiling suspended socket holder fixture with the lamp shade in phantom.

Turning now descriptively to the drawings, in which similar reference characters denote similar elements throughout the several views, the Figures illustrate a light emitting foldable decoration 10 for a socket holder fixture 12 with a 25 watt light bulb 14 suspended by a power cord 16 from a mounting plate 18 on a ceiling 20 of a building 22. The decoration 10 consists of a structure 24, connected to the socket holder fixture 12, for screening the light bulb 14. Another structure 26 is for covering the screening structure 24, so that the covering structure 26 will allow some of the light illuminating from the light bulb 14 to enhance the appearance of the covering structure 26.

The screening structure 24 is a lamp shade 28 that includes a cup-shaped housing 30 having an open bottom end 32 and a closed top end 34 with a central aperture 36 therethrough to allow the neck 38 of the light bulb 14 to pass through the central aperture 36.

The lamp shade 28 further includes the cup-shaped housing 30, having a plurality of small openings 40 in the closed top end 34 radially positioned about the central aperture 36 to allow hot air rising from the heat of the light bulb 14 to exit therefrom. The cup-shaped housing 30 is fabricated out of a hard, rigid, dimensionally stable, clear thermoplastic polymer 42.

The covering structure 26 is an extendable adornment 44 having a compartment 46 sized to fit about the cup-shaped housing 30, when placed in an opened position. Fasteners 48 are for securing the extendable adornment 44 in its opened position "A" about the socket holder fixture 12. The extendable adornment 44 is a three dimensional geometric shaped embellishment 50, that can be collapsed into a closed position and be stored when not in use.

The three dimensional geometric shaped embellishment 50 is fabricated in any conventional manner out of a thin translucent flexible material 52 having fold lines 54, so that it can be brought from the closed position to the opened position to fit about the cup-shaped housing 30. The thin translucent flexible material 52 is paper. The three dimensional geometric shaped embellishment 5 can be a star ornament, having a plurality of radiating points 58.

The star ornament 56 is perforated in various locations 60 to allow more of the light illuminating from the light bulb 14 to shine therethrough to further enhance its appearance. Each of the radiating points of the star ornament 56 has an area 62 located thereon for indicia, so as to indicate messages and the like.

The fasteners 48 are a pair of strings 64, with each affixed in any conventional manner to one side of the star ornament 56, so that when the star ornament 56 is in the opened position, the strings 64 will come together to be tied about the socket holder fixture 12.

To install and operate the light emitting foldable decoration 10, the following steps should be taken:

1. Unscrew the light bulb 14 from the socket holder fixture 12.

2. Place the neck 38 of the light bulb 14 through the central aperture 36 in the closed top end 34 of the cup-shaped housing 30, which is the lamp shade 28.

3. Screw the light bulb 14 back into the socket holder fixture 12.

4. Hold the strings 64 with both hands.

5. Gently unfold the extendable adornment 44 by going into the opened position.

6. Place the compartment 46 over the socket holder fixture 12, the light bulb 14 and the lamp shade 28.

7. Tie the strings 64 together above the socket holder fixture 12, so as to form the star ornament 56.

8. Turn the light bulb 14 on so that the light can illuminate the star ornament 56, with some of the light going through the perforations 60.

LIST OF REFERENCE NUMBERS

10 light emitting foldable decoration
12 socket holder fixture
14 25 watt light bulb
16 power cord
18 mounting plate
20 ceiling
22 building
24 screening structure
26 covering structure
28 lamp shade for 24
30 cup-shaped housing
32 open bottom end on 30
34 closed top end on 30
36 central aperture in 34
38 neck of 14
40 small opening in 34
42 clear thermoplastic polymer
44 extendable adornment for 26
46 compartment in 44
48 fastener
50 three dimensional geometric shaped embellishment for 44
52 thin translucent flexible material
54 fold line on 50
56 star ornament for 50
58 radiating point on 56
60 perforations in 56
62 area on 56
64 string for 48

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the ar without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A light emitting foldable decoration for a socket holder fixture with a 25 watt light bulb suspended by a power cord from a mounting plate on a ceiling of a building, said decoration comprising:

a) means connected to the socket holder fixture, for screening the light bulb, said screening means is a lamp shade, said lamp shade includes a cup-shaped housing having an open bottom end and a closed top end with a central aperture therethrough to allow the neck of the light bulb to pass through said central aperture, said cup-shaped housing having a plurality of small openings in said closed top end radially positioned about said central aperture to allow hot air rising from the heat of the light bulb to exit therefrom; and b) means for covering said screening means, so that said covering means will allow some of the light illuminating from the light bulb to enhance the appearance of said covering means, said covering means includes an extendable adornment having a compartment sized to fit about said cup-shaped housing when placed in an opened position and means for securing said extendable adornment in its opened position about the socket holder fixture, said extendable adornment is a three dimensional geometric shaped embellishment that can be collapsed into a closed position and be stored when not in use, said three dimensional geometric shaped embellishment is a star having a plurality of radiating points, each of said points defining a hollow compartment therein and combining centrally to form a hollow central compartment for said cup-shaped housing so that said cup-shaped housing will remain hidden from observers of said star.

2. A light emitting foldable decoration as recited in claim 1, wherein said cup-shaped housing is fabricated out of a hard, rigid, dimensionally stable, clear thermoplastic polymer.

3. A light emitting foldable decoration as recited in claim 1, wherein said three dimensional geometric shaped embellishment is fabricated out of a thin translucent flexible material having fold lines, so that it can be brought from the closed position to the opened position to fit about said cup-shaped housing.

4. A light emitting foldable decoration as recited in claim 3, wherein said thin translucent flexible material is paper.

5. A light emitting foldable decoration as recited in claim 4, wherein said star ornament has perforations in various locations to allow more of the light illuminating from the light bulb to shine therethrough to further enhance its appearance.

6. A light emitting foldable decoration as recited in claim 5, wherein each of said radiating points of said star ornament has an area located thereon for indicia, so as to indicate messages.

7. A light emitting foldable decoration as recited in claim 6, wherein said securing means includes a pair of strings each affixed to one side of said star ornament, so that when said star ornament is in the opened position, said strings will come together to be tied about the socket holder fixture.

* * * * *